US005620772A

United States Patent [19]

Taniguchi

[11] Patent Number: 5,620,772

[45] Date of Patent: Apr. 15, 1997

[54] DECORATING SHEET HAVING HAMMER TONE TEXTURE

[75] Inventor: Michio Taniguchi, Yamagata, Japan

[73] Assignee: Minnesota Mining and Manufacturing Company, Saint Paul, Minn.

[21] Appl. No.: 403,688

[22] PCT Filed: Mar. 17, 1995

[86] PCT No.: PCT/US95/03371

§ 371 Date: Mar. 17, 1995

§ 102(e) Date: Mar. 17, 1995

[87] PCT Pub. No.: WO95/26834

PCT Pub. Date: Oct. 12, 1995

[30] Foreign Application Priority Data

Mar. 30, 1994 [JP] Japan ..... 6-060647

[51] Int. Cl.[6] ..... B05D 5/06

[52] U.S. Cl. ..... 428/143; 428/141; 428/215; 428/331; 428/328; 428/424.4; 428/483; 428/913.3; 427/561; 427/565; 427/568; 427/204; 427/199; 427/257; 427/372.2; 427/387; 427/280

[58] Field of Search ..... 428/141, 143, 428/215, 331, 328, 424.4, 483, 913.3; 427/561, 565, 568, 704, 199, 257, 372.2, 387.2, 280

[56] References Cited

U.S. PATENT DOCUMENTS 3,935,147 1/1976 Godshalk et al. ..... 260/826
4,686,261 8/1987 Naito ..... 525/131
4,812,336 3/1989 Okamoto et al. ..... 427/257

FOREIGN PATENT DOCUMENTS 1729866 11/1971 Germany ..... B29J 1/04
63-91168 4/1988 Japan ..... B05D 1/12

OTHER PUBLICATIONS

Trade Association for Wall–Covering Material of Tokyo, *Interior Encyclopedia,* Tokyo, Japan, pp. 697–698, (1988).

Japanese Industrial Standard, "Float and Polished Plate Glasses, JIS R 3203", Edition 4, Tokyo, Japan (Mar. 1, 1991).

Japanese Industrial Standard, "Surface roughness—Definitions and designation, JIS B 0601", Edition, 1, Tokyo, Japan (Feb. 1, 1994).

ALEXIT–Hammerschlaglack 2:1 (ALEXIT–Hammer–Metal–Finish) product data sheet, Mankiewicz Egbr. & Co., Hamburg, Germany (May 1990).

*Primary Examiner*—William Watkins
*Attorney, Agent, or Firm*—Gary L. Griswold; Walter N. Kirn; John H. Hornickel

[57] ABSTRACT

This invention discloses a decorative sheet having a hammer tone texture and the method used to obtain such hammer tone texture. A hammer tone composition is agitated, applied to a decorative sheet using a controlled means of delivery in a sufficient thickness, and then dried at a sufficient temperature and for a sufficient time to provide the hammer tone texture on the decorative sheet.

6 Claims, 1 Drawing Sheet

DECORATING SHEET HAVING HAMMER TONE TEXTURE

FIELD OF THE INVENTION

The present invention relates to a decorative sheet having a "hammer tone" texture. Hammer tone texture has been used in various fields, because it gives a beautiful finishing effect even when the surface of the backing is rough to some degree.

BACKGROUND OF THE INVENTION

Usually decorative sheets have been made using by the following processes: (a) a resin film is formed on a paper surface by coating a polyvinyl chloride resin sol on the paper surface, (b) a vinyl chloride sheet as a backing is subjected to printing, embossing, or other working, (c) a foaming agent is used to produce a three dimensional appearance, or (d) flake-like or pellet-like chips are sprayed and adhered at random in order to provide a stereoscopic appearance. See, for example, *Interior Encyclopedia* published by the Trade Association for Wall-Covering Materials of Tokyo, Japan in 1988 at pages 697 and 698.

If a stereoscopic texture called "hammer tone" (i.e., as if hammered at random to form a three dimensional or other stereoscopic appearance) is attempted to be produced by the printing or embossing processes as described above, a poor stereoscopic appearance results because the same pattern appears repeatedly according to the circumference of the printing roll or embossing roll. No random texture is formed.

If a foaming agent is used, the expression of stereoscopic appearance is reduced. If a decorative sheet is adhered using chips, flaking of the chips is troublesome.

Usually in order to obtain a hammer tone texture, paint containing silicone resin is used. Japanese Unexamined Patent Publication (Kokai) No. 63-91168 discloses a coating composition containing a powdered silicone resin to form a hammer tone texture to form on a painted surface. Such a coating composition causes a hammer tone texture to appear because the silicone resin repels the coating composition components on the surface of the coating composition due to the low surface tension of the silicone resin. This is a non-wetting phenomenon. However, since a silicone resin has a low surface tension and is poor in compatibility with other coating composition components, it must be constantly immersed in a solvent. Thus, it has been difficult to coat a silicone resin by a method substantially other than spray coating.

However, application by spray coating has involved the following problems or restrictions:

(a) Thick application or uniform coating is difficult.

When spray coating is conducted in a vertical direction, a problem of so-called "sagging" of the coating often occurs.

(c) Since the capacity of a spraying can is limited, it is difficult to effect spray coating over a large area at one time without refilling or using a new spraying can.

(d) In spray coating, very accurate viscosity adjustment is required to prevent clogging at the nozzle portion. A diluent or injection gas become indispensable for use in spraying.

(e) After coating,, the coated object must be dried under for about 6 hours without heat or under strict drying conditions of about 180° C. and about 20 minutes if crosslinking of coating is required.

Accordingly, it has been difficult to use the conventional silicone resin coating composition as decorative film, especially a decorative film that can be stored on a roll.

SUMMARY OF THE INVENTION

One aspect of the present invention recognizes the following preferred features in a decorative sheet having a hammer tone texture, especially a long sheet having a hammer tone texture that can be stored in a roll form until use:

(a) to form a hammer tone texture exhibiting stereoscopic appearance free from repetition of the same pattern, (b) to easily form a decorative layer having a uniform and large area hammer tone texture, (c) that very accurate viscosity adjustment is unnecessary, that neither diluent nor injection gas is necessary, and that production cost is low.

(d) that the drying temperature for hammer tone coating composition is lower than that used for spraying techniques.

Another aspect of the invention relates to a decorative sheet having a hammer tone texture, containing a backing sheet, primer layer, and decorative layer, the decorative layer having a surface roughness of 6 μm or more.

The decorative sheet having a hammer tone texture of the present invention comprises a backing sheet, a primer layer on the backing sheet, and a decorative layer on the primer layer, the decorative layer formed by applying the decorative layer in the form of a hammer tone coating composition using a controlled means of delivery of the composition to the primer layer at a sufficient thickness after mixing with sufficient agitation and then drying for sufficient time at a sufficient temperature in order to form a surface having a surface roughness Ra of 6 μm or more.

"Surface roughness" also known as Ra, is a measurement standardized by the JIS B-0601-1994 as published by Japanese Standards Association of Tokyo, Japan. If a surface roughness or Ra is less than about 6 μm, it not possible to obtain a satisfactory rugged appearance desired for the hammer tone texture. Also, uniformity of the hammer tone texture is lacking. For texture stability, a surface roughness or Ra of at least about 7.5 μm is preferred.

The hammer tone coating composition used in the present invention produces a hammer tone texture because silicone particles compounded in the coating composition, which are finely dispersed in the coating composition, repel the other coating composition ingredients. A beautiful pattern of the hammer tone coating composition depends on the rugged conditions thereof.

Thus, the mixing conditions for the ingredients of the coating composition are important, and when the ingredients are mixed too much or too little, a beautiful hammer tone texture is not obtained.

However, there has never been known a method for obtaining the mixing-stirring conditions wherein the mixing is conducted neither too much or too little.

The present invention provides a method to solve the mixing-stirring conditions to create a decorative layer having a beautiful hammer tone texture.

The present invention provides a method in which the ingredients of the hammer tone composition are mixed under specific conditions, coated on the desired surface and dried under specific conditions, in order to produce a beautiful hammer tone texture measured by surface roughness or Ra.

The method of making a decorative sheet having a hammer tone texture comprises the steps of agitating a hammer tone coating composition; applying the agitated hammer tone composition to a backing sheet using a controlled means of delivery of the composition at a sufficient thickness to provide a stereoscopic appearance; and drying the applied hammer tone composition for sufficient time at a sufficient temperature in order to form a surface on the backing sheet having a surface roughness Ra of 6 μm or more.

A standardized test can be used to determine the success of the method of the present invention to obtain the desired surface roughness or Ra.

Using this test, it has been found that when the ingredients of a hammer tone coating composition, mixed under agitation under specific conditions described below, are coated on the surface of the float plate glass standardized by JIS R-3202-1985 (Japanese Standards Association of Tokyo, Japan) to a dry thickness ranging from 50 to 80 μm and dried at a temperature within the specified range and for a period of time within the specified range, the surface roughness Ra standardized by JIS B-0601-1994 (Japanese Standards Association of Tokyo, Japan) becomes 6 μm or more.

In practice then, the amount of agitation, the controlled means of delivery of the composition to the desired surface, the thickness of the coating, and the temperature and time of drying the coating composition can be used to determine the surface roughness or Ra and the resulting desired hammer tone texture obtained.

"Controlled means of delivery" means that the method of applying the composition to the surface is not random or variable, such as by spraying techniques previously used to form a hammer tone texture. Nonlimiting examples of controlled means of delivery include knife coaters, roll coaters, die coaters, gravure coaters, or silk screens.

Thus, the present invention provides a decorative sheet having a hammer tone texture, comprising a backing sheet, a primer layer on the backing sheet, and a decorative layer on the primer layer, said decorative layer formed by applying the decorative layer in the form of a hammer tone coating composition using a controlled means of delivery of the composition to the primer layer at a sufficient thickness after mixing for with sufficient agitation and then drying for sufficient time at a sufficient temperature in order to form a surface having a surface roughness Ra of 6 μm or more.

The advantages obtainable according to the present invention are as follows:

(1) A hammer tone texture of stereoscopic appearance free from repetition of the same pattern can be formed on a decorative sheet, especially in the form of a long sheet.

(2) A decorative sheet having a uniform and large area hammer tone texture can be produced.

(3) Owing to the above effects, a large area can be decorated with a decorative sheet having a hammer tone texture.

(4) Unlike spray coating as used previously, a diluting solvent is unnecessary in the process of the present invention. Avoiding additional chemicals reduces production costs.

(5) The drying time for the coating composition can be shortened.

(6) Since the product of the present invention is formed into a sheet form, the product is not likely to be contaminated in a way that detracts from the hammer tone texture of the decorative sheet.

(7) Since the product of the present invention is formed into a sheet form, articles prepared from the decorative sheet are not influenced by the processing conditions used to form the decorative sheet. A good final appearance can be obtained.

Further features and advantages of the invention are described with respect to embodiments of the invention in relation to the drawing.

EMBODIMENTS OF THE INVENTION

Figure 1:
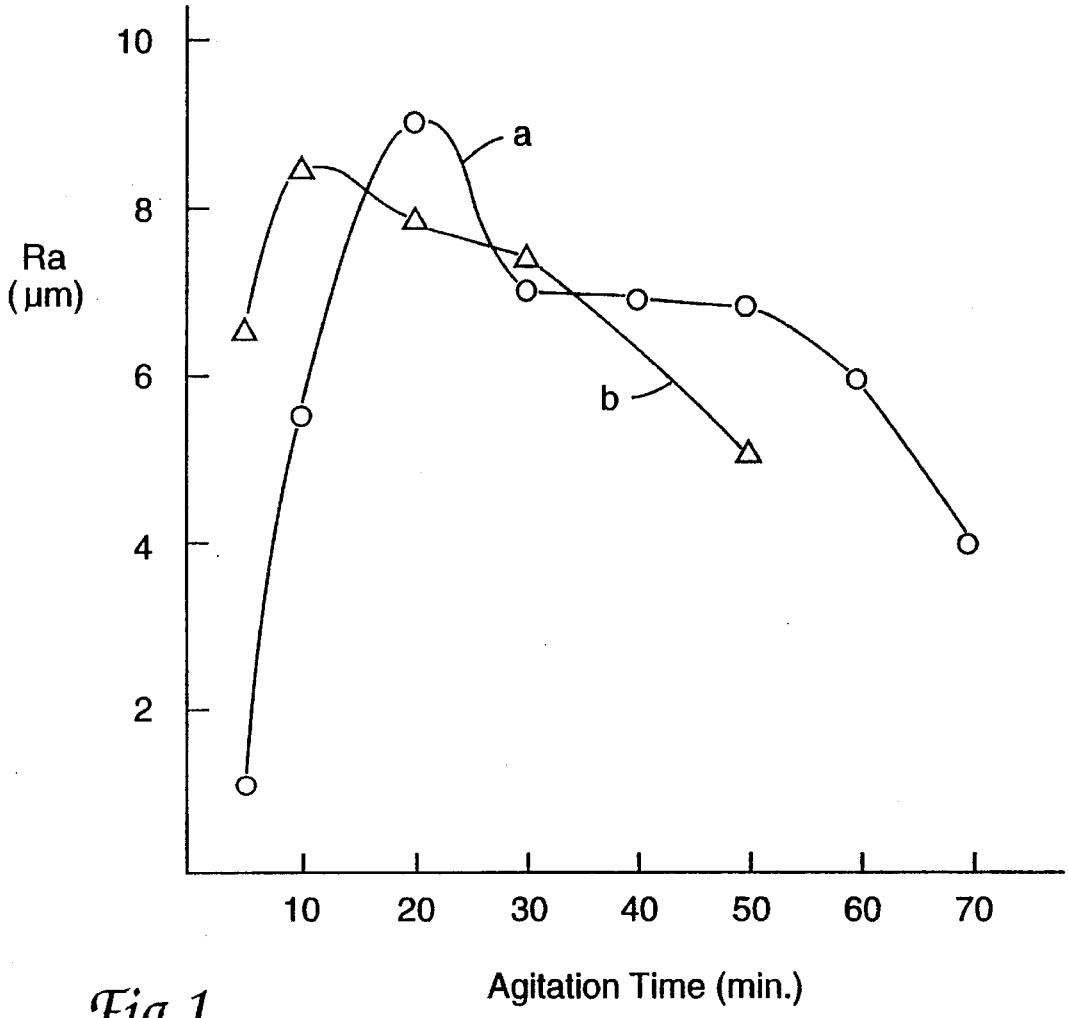
FIG. 1 is a graph showing the relation between the stirring time and the surface roughness or Ra, at a predetermined number of revolutions.

The hammer tone texture herein referred is a beautiful stereoscopic pattern forming a rugged surface appearance made of closely contacted crater-shaped concaves formed in such a way that independent bubbles of spherical or spheroidal bubbles having a size ranging from 0.1 to 0.5 mm, preferably from 0.5 to 2 mm, or independent bubbles formed by the connection of some of the above spherical or spheroidal bubbles, uniformly distributed in a film, are broken to form concave shapes on the surface and then solidified.

The decorative sheet having a hammer tone texture according to the present invention generally comprises a backing sheet, a primer layer provided thereon, and a hammer tone coating composition provided thereon to form a decorative layer having a hammer tone texture. The primer layer can be also serve as the backing sheet. In addition, on the reverse side of the backing sheet, a layer of a pressure-sensitive adhesive or hot-melt or hot-tack adhesive can be provided with and a releasable sheet (a release-treated paper is generally used.) provided thereunder.

The decorative sheet of the present invention in this construction can have the releasable sheet peeled away and the layer of adhesive stuck to an object to be coated, which facilitates the application at the job site of the decorative sheet of the present invention.

In addition, a protective layer can be optionally provided on the decorative layer for the purpose of improving resistance to dirt and otherwise enhance durability.

The backing sheet gives mechanical support at the time of production, transportation, and storage of the decorative sheet of the present invention. Nonlimiting examples of a backing sheet useful in the present invention include paper, and polymeric sheets made of vinyl chloride resin, polyester, polypropylene, acrylic resin, methacrylic resin, urethane resin or a mixture of them. Among them, a vinyl chloride resin sheet is preferable. The thickness of the sheet is within the range between 20 and 200 μm, preferably between 50 and 150 μm, and more preferably between 70 and 100 μm.

The primer layer joins the backing sheet to the hammer tone decorative layer. Nonlimiting examples of primer layers include vinyl chloride resin, vinyl acetate resin, rubber, epoxy resin, and urethane resin. Among them, vinyl acetate resin is preferable. The thickness of this primer layer is within the range between 0.1 to 50 μm, preferably between 5 and 40 μm, and more preferably between 10 and 30 μm. If necessary, this primer may bear most of the functions of the backing sheet. For example, when the backing sheet is a vinyl chloride resin, and the primer layer is a vinyl acetate resin, the primer layer is thickened so as to bear the greater part of the supporting function. Even in such a case, the vinyl chloride resin plays an important role for imparting flexibility of the decorative sheet as a whole.

The hammer tone coating composition contains, in general, silicone particles, a resin component, metal flakes, a solvent and pigment. Nonlimiting examples of the silicone particles include the particles of high molecular weight polydimethyisilioxane. Nonlimiting examples of the resin component include urethane resin, acrylic resin, polyester resin, and melamine resin. Among them, urethane resin is preferable. Nonlimiting examples of the aforesaid metal flakes include the powder of an aluminum foil and pearl powder (titanium-coated mica pieces). Nonlimiting examples of the solvent include ethanol, isopropanol, n-propanol, n-butanol, isobutanol, t-butanol, cyclohexane, toluene, methyl ethyl ketone, methyl isobutyl ketone, and the like. Nonlimiting examples of the pigment include carbon black, titanium oxide, red iron oxide, ochre (yellow iron oxide), phthalocyanine blue, phthalocyanine green, quinacridone yellow pigment, precipitated barium sulfate, talc, calcium carbonate, clay, silica, and the like.

Hammer tone coating compositions useful in the present invention are commercially available, such as . e.g. "ALEXIT-Hammerschlaglack"™ (produced by MANKIEWICZ GEBR. & CO., Germany), previously useful for spraying as described in the Background of the Invention above.

Hammer tone coating compositions used in prior processes used large sized silicone particles, and required long and hot drying conditions for the purpose of causing a cross-linking reaction.

On the contrary, in the process of the present invention, because the silicone particles are mechanically dispersed and therefore converted into finer particles and uniformly dispersed, the drying conditions (temperature, time) can be made less severe. For example, drying at a temperature of 120° C., for a period of time ranging from 2 to 7 minutes, suffices.

The thickness of the coating composition herein referred means the thickness of the thickest portion of the coating composition. The thickness of the coating composition is within the range between 30 and 150 μm, preferably between 40 and 100 μm, and more preferably between 50 and 80 μm. When the thickness is less than 30 μm, the hammer tone texture becomes poor in stereoscopic appearance. On the other hand, when the thickness exceeds 150 μm, the uniformity of the pattern becomes impaired. The thickness of the coating composition is most preferably about 60 μm in consideration of the durability of the film and the stability of the beautiful pattern.

Because the surface pattern of a hammer tone texture is uneven, the thickness of the coating composition needs to be thick enough to avoid drying into a decorative layer that is too thin to provide the stability of a beautiful pattern. This can occur when the thickness of the coating composition is less than about 30 μm and parts of the coating are about 10–20 μm. On the other hand, when the coating composition is too thickly applied, a bubble is liable to be joined to the surrounding bubbles, resulting in an unstable appearance upon drying. "Stability of a beautiful pattern" means that the decorative layer suffers from neither a too thin nor a too thick coating thickness and avoids bubble instability or thinness instability.

The resulting surface thickness of the decorative layer is at least 6 μm or more on the basis of the surface roughness or Ra of 6 μm standardized by JIS B-0601. The surface thickness is set preferably much above 6 μm, in order that a sufficiently beautiful hammer tone texture may be obtained on a decorative layer of sufficient, durable, and substantially uniform thickness. For example, the thickness of the decorative layer can range in the same thicknesses as the the thicknesses of the coating composition described above and preferably from about 50 to about 80 μm and preferably about 60 μm. With a decorative layer having a thickness of this range, the surface roughness is more preferably 7 μm or more.

For the layer of the pressure-sensitive adhesive or hot-melt or hot-tack adhesive, one can use layers of acrylic resin, silicone resin, vinyl chloride resin, urethane resin, and rubber. The thickness of this layer is within the range between 10 and 100 μm, preferably between 15 and 75 μm, and more preferably between 20 and 50 μm.

The decorative sheet having a hammer tone texture can be produced in such a way as to predictably obtain a surface roughness of at least 6 μm. As described above, the test involves determining the conditions of appropriate mixing for use in the decorative sheet of the present invention by mixign the composition under those conditions and then coating the hammer tone coating composition on the surface of a float plate glass standardized by JIS R-3202 to a dry thickness ranging from 50 to 80 μm and subsequently dried at a temperature ranging from 120° to 180° C. for a period of time ranging from 2 to 15 minutes, the surface roughness Ra standardized by JIS B-0601 becomes 6 μm or more.

FIG. 1 shows the relationship found between the mixing conditions and the surface roughness using the above described test. Using two different mixing revolutions per minute, the variation of ultimate surface roughness compared with the agitation time is shown.

With the hammer tone coating compositions being mixed under these conditions, the resulting mixture is applied onto the primer provided on the backing sheet to a dry thickness ranging from 30 to 150 μm, and dried at a temperature ranging from 120° to 200° C. and for a time ranging between about 1 and 15 minutes.

To make decorative sheets according to the present invention, the backing sheet is primed with the primer layer according to techniques known to those skilled in the art. Then, the ingredients of the coating composition are mixed under agitation conditions shown in FIG. 1, using a mixer, (e.g., a ball mill, a disperser, a microfliuidizer, and the like,) and the obtained mixture is coated by use of a coating means such as a knife coater, a roll coater, a die coater, a gravure coater, a silk screen, or other coating means that can provide a controlled means of delivery of the composition in order to produce a substantially uniform thickness. Subsequently, the coated coating composition is dried at a temperature ranging from 120° to 200° C.

The drying is conducted for between about 1 and 15 minutes to avoid on the one hand the coating composition being tacky as the sheet is rolled for storage.

On the other hand, if the coating composition is dried at a high temperature for too long, the decorative sheet becomes cracked or some ingredients in the decorative sheet get scorched. Therefore, the drying is conducted under such temperature-time conditions which do not cause such troubles. Further, drying for a period of time longer than 15 minutes requires large scale equipment, for even a low temperature drying effort, so that the economic benefits of the present invention over the prior art processes are lost.

The hammer tone coating composition produces a hammer tone texture because the silicone particles compounded in the coating composition, which are finely dispersed in the coating composition, repel the other coating composition ingredients. A beautiful pattern of the hammer tone coating composition depends on the rugged conditions thereof.

Thus, the mixing conditions for the ingredients are important, and when the ingredients are mixed too much or too little a beautiful hammer tone texture is not obtained.

Applying the test described above and determining the appropriate mixing conditions, coating thickness, and time and temperature of drying provides a predictable surface roughness and assures a beautiful hammer tone texture for the decorative layer on the decorative sheet.

The pressure-sensitive adhesive layer and release sheet layer to be provided if necessary can be provided by an ordinary method.

Further explanation of the embodiments of the invention can be found in the following examples.

EXAMPLES

The following, working examples do not limit the scope of the present invention.

Examples 1–13

On a release coated paper with a thickness of 150 μm, there was coated a vinyl chloride resin by a knife coater, so as to form a backing film with a thickness of 70 μm. On the thus formed film, there was coated as a primer layer a vinyl acetate resin, so as to form a layer with a thickness of 20 μm. On the thus formed vinyl acetate resin primer layer, there was knife coated (with a gap ranging from 170–320 μm) a hammer tone coating composition ("ALEXIT-Hammerschlaglack"™ 2:1 produced by MANKIEWICZ GEBR. & CO., Hamburg, Germany) after mixing under agitation under various conditions set forth in Table 1, dried for 10 minutes at a temperature of 120° C., so as to produce a decorative sheet. The dry thickness of the hammer tone coating composition was found to be 60 μm.

The aforesaid mixing under agitation was conducted under various conditions set forth in Table 1, by a Cowles mixer having a circular blade with a diameter of 20 cm, after 60 kg of hammer tone coating composition had been introduced into a 180 liter drum can.

With respect to the obtained decorative sheets, there were conducted visual evaluations of the appearances of the hammer tones textures. The evaluation results, surface roughnesses of the decorative layers of the obtained decorative sheets, particle sizes of the used silicone particles, dispersion degrees of the obtained silicone particles, and dried conditions of the decorative sheets are set forth in Table 1. Further, a graph showing the relation between the stirring time and the surface roughness Ra at a predetermined number of revolution is shown in FIG. 1. The evaluation results for hammer tone appearance were expressed by the following evaluation rating:

VG: very good

G: good

F: fairly appears

NG: not at all appears

The silicone particles were microscopically observed, and the particle sizes were expressed by the following standards:

L: 300 μm or more

M: 200 μm or more and less than 300 μm

S: less than 200 μm

The dispersion degrees of silicone particles were expressed by the following standards on the basis of the number of particles in an area of 1 $cm^2$, which had been obtained by microscopic observation of the particles.

CS: less than 5

MD: 5 or more and less than 10

HM: 10 or more

The dried conditions were expressed by the following rating on the basis of the results obtained by surface finger touch:

VG: completely free from surface tackiness

G: slightly surface-tacky

NG: completely surface-tacky

TABLE 1

| Example. | Number of Revolution (rpm) | Agitation Time (min) | Ra (μm) | Silicone Particle Diameter | Particles Dispersion Degree | Dried Condition | Appearance |
|---|---|---|---|---|---|---|---|
| 1 | 500 | 5 | 1.0 | L | CS | NG | NG |
| 2 | 500 | 10 | 5.5 | L | CS | NG | NG |
| 3 | 500 | 20 | 9.0 | M | HM | G | VG |
| 4 | 500 | 30 | 7.0 | M | HM | G | VG |
| 5 | 500 | 40 | 6.9 | S | HM | G | G |
| 6 | 500 | 50 | 6.7 | S | HM | G | G |
| 7 | 500 | 60 | 5.9 | S | MD | G | NG |
| 8 | 500 | 70 | 4.0 | S | CS | G | NG |
| 9 | 1000 | 5 | 6.5 | M | HM | G | G |
| 10 | 1000 | 10 | 8.4 | M | HM | G | VG |
| 11 | 1000 | 20 | 7.8 | S | HM | G | VG |
| 12 | 1000 | 30 | 7.4 | S | HM | G | VG |
| 13 | 1000 | 50 | 5.1 | S | CS | G | NG |

Table 1 and FIG. 1 show that with coating thickness, drying temperature, and drying time remaining constant, agitation time between 10 and 50 minutes at 500 revolutions per minute and below 50 minutes at 1000 revolutions per minute resulted in surface roughness measurements of above 6 μm.

Examples 14–23

On a primer provided on a backing sheet produced in the same way as in Example 1, there were knife coated coating compositions prepared under the condition No. 3 confirmed in Example 1 (500 rpm, 20 minutes) to the various thicknesses set forth in Table 2, respectively, and the coating compositions thus coated to various thicknesses were dried for 5 minutes at a temperature of 150° C., respectively, and the hammer tone appearances thereof were visually evaluated, so as to obtain the thicknesses imparting good appearances.

The obtained results are set forth in Table 2. The evaluations of hammer tone appearances were expressed by the following rating:

VG: very good

G: good
F: fairly appears
NG: not at all appears.

TABLE 2

| Example No. | Knife Gap-Delivered Thickness (μm) | Dry Thickness (μm) | Hammer Tone Appearance |
|---|---|---|---|
| 14 | 120 | 20 | NG |
| 15 | 140 | 30 | F |
| 16 | 160 | 40 | F |
| 17 | 180 | 50 | G |
| 18 | 200 | 60 | VG |
| 19 | 220 | 70 | G |
| 20 | 240 | 80 | G |
| 21 | 280 | 100 | F |
| 22 | 350 | 150 | F |
| 23 | 400 | 200 | NG |

With mixing conditions, drying temperature, and drying time remaining constant, Table 2 shows a dried thickness ranging from above 20 and below 200 μm and preferably between about 30 to about 150 μm resulted in preferred surface roughness.

Examples 24–38

On a primer provided on a backing sheet produced in the same way as in Example 1, there were knife coated coating compositions (at a gap of 200 μm) prepared under the condition No. 3 confirmed in Example 1 (500 rpm, 20 minutes) to the thickness of 60 μm, and the coating compositions thus coated were dried for various times at various temperatures, respectively, and the dried conditions were examined by surface finger touch, and evaluated by the following standard.
G: not sticky and no crack
F: slightly sticky or a few cracks
NG: sticky

TABLE 3

| | Drying Conditions | | |
|---|---|---|---|
| Experiment No. | Temperature (°C.) | Time (min) | Evaluation |
| 1 | 90 | 3 | NG |
| 2 | 90 | 5 | NG |
| 3 | 120 | 3 | F |
| 4 | 120 | 5 | F |
| 5 | 140 | 5 | F |
| 6 | 140 | 10 | G |
| 7 | 140 | 15 | G |
| 8 | 150 | 3 | F |
| 9 | 150 | 5 | G |
| 10 | 150 | 7 | G |
| 11 | 150 | 10 | F |
| 12 | 180 | 3 | G |
| 13 | 180 | 5 | G |
| 14 | 180 | 7 | F |
| 15 | 200 | 1 | F |

With mixing conditions and coating thickness remaining constant, Table 3 shows how the variation in drying temperature and drying time affects the resulting surface roughness of the hammer tone texture. Using a temperature above 90° C. provides a decorative layer having an acceptable surface.

While embodiments of the invention have been described, the invention is not limited to them. For an appreciation of the scope of the present invention, the claims follow.

What is claimed is:

1. A decorative sheet having a hammer tone texture, comprising a backing sheet having a thickness within the range between 20 and 200 μm, primer layer on the backing sheet, said primer layer consisting essentially of vinyl acetate resin and having a thickness within the range between 0.1 and 100 μm, and a decorative layer on the primer layer, said decorative layer having a thickness within the range between 30 and 150 μm formed by applying the decorative layer in the form of a hammer tone coating composition using a controlled means of delivery of the composition to the primer layer at a sufficient thickness after mixing with agitation time between 10 and 50 minutes at 500 revolutions per minute or below 50 minutes at 1000 revolutions per minute and then drying for a period of time ranging from 1 to 15 minutes at a temperature ranging from 120° C. to 200° C. in order to form a surface having a surface roughness Ra of 6 μm or more.

2. The decorative sheet according to claim 1 wherein the decorative layer is composed of a coating composition containing silicone particles and aluminum powder.

3. The decorative sheet having a hammer tone texture as claimed in claim 1, wherein said backing sheet consists essentially of a vinyl chloride resin, and said decorative sheet consists essentially of an urethane resin.

4. The decorative sheet having a hammer tone texture as claimed in claim 1, further comprising a layer of pressure sensitive adhesive on a reverse side of the backing sheet.

5. A method of making a decorative sheet having a hammer tone texture comprising the steps of:

(a) agitating a hammer tone coating composition for a time between 10 and 50 minutes at 500 revolutions per minute or below 50 minutes at 1000 revolutions per minute;

(b) priming a backing sheet having a thickness within the range between 20 and 200 μm with a primer layer, wherein primer layer consists essentially of a vinyl acetate resin and has a thickness within the range between 30 and 150 μm;

(c) applying the agitated hammer tone composition to the primer, layer using a controlled means of delivery of the composition at a sufficient thickness to provide a stereoscopic appearance; and (d) drying the applied hammer tone composition for a period of time ranging from 1 to 15 minutes at a temperature ranging from 120° C. to 200° C. in order to form a surface on the backing sheet having a surface roughness Ra of 6 μm or more and having a thickness within the range between 30 and 150 μm.

6. The method according to claim 5, wherein the controlled means of delivery of the composition comprises a knife coater, a roll coater, a die coater, a gravure coater, or a silk screen.

* * * * *